US011738976B1

(12) United States Patent
Tian et al.

(10) Patent No.: US 11,738,976 B1
(45) Date of Patent: Aug. 29, 2023

(54) HYDRAULIC JACK

(71) Applicant: NINGBO TOGETHER TRADING CO., LTD., Zhejiang (CN)

(72) Inventors: Huike Tian, Zhejiang (CN); Kejin Xia, Zhejiang (CN)

(73) Assignee: NINGBO TOGETHER TRADING CO., LTD., Ningbo (CN)

( * ) Notice: Subject to any disclaimer, the term of this patent is extended or adjusted under 35 U.S.C. 154(b) by 0 days.

(21) Appl. No.: 17/730,184

(22) Filed: Apr. 26, 2022

(30) Foreign Application Priority Data

Feb. 14, 2022 (CN) ..... 202210134230.1
Feb. 14, 2022 (CN) ..... 202220298101.1

(51) Int. Cl.
*B66F 3/42* (2006.01)
*B66F 3/38* (2006.01)
*F15B 13/02* (2006.01)
*F15B 15/26* (2006.01)

(52) U.S. Cl.
CPC ..... *B66F 3/42* (2013.01); *B66F 3/38* (2013.01); *F15B 13/02* (2013.01); *F15B 15/26* (2013.01); *B66F 2700/052* (2013.01)

(58) Field of Classification Search
CPC .... B66F 1/025; B66F 1/08; B66F 3/24; B66F 3/247; B66F 3/28; B66F 3/42; B66F 5/04; B66F 7/04; B60S 9/02; B60S 9/10; B60S 9/12
USPC ..... 259/93 R, 93 H; 254/89 H, 97, 98
See application file for complete search history.

(56) References Cited

U.S. PATENT DOCUMENTS 4,815,711 A * 3/1989 Bruno ..... B66C 23/80 254/423
5,524,868 A * 6/1996 Decker ..... B66F 3/42 254/93 H
5,975,496 A * 11/1999 Hong ..... B66F 3/42 60/486
6,155,536 A * 12/2000 Digman ..... B66F 1/08 254/100
2005/0172793 A1* 8/2005 Fox ..... B66F 3/24 91/170 R
2010/0258775 A1* 10/2010 Zhengwei ..... B66F 1/04 254/93 H

* cited by examiner

*Primary Examiner* — Lee D Wilson
*Assistant Examiner* — Tyler James McFarland

(57) ABSTRACT

The present disclosure provides a hydraulic jack, including a base as a carrier for mounting other components; an inner cylinder barrel vertically fixed to the base, a sliding cavity being formed in the inner cylinder barrel; an outer cylinder barrel vertically and slidably fitted outside the inner cylinder barrel; a valve plug assembly slidably fitted in the sliding cavity, and the valve plug assembly being rigidly connected to the outer cylinder barrel via a valve plug rod and being able to slide synchronously with the outer cylinder barrel; a valve plug driving assembly mounted on the outer cylinder barrel; and a supporting component mounted on the side wall of the outer cylinder barrel in an up-down adjustable mode. The hydraulic jack of the present disclosure is compact in structure, high in strength, high in load capacity, long in stroke, and safe and reliable in use.

9 Claims, 9 Drawing Sheets

HYDRAULIC JACK

CROSS REFERENCE TO RELATED APPLICATIONS

The present application claims the benefit of Chinese Patent Application Nos. 202210134230.1 and 202220298101.1 filed on Feb. 14, 2022. All the above are hereby incorporated by reference in their entirety.

TECHNICAL FIELD

The present disclosure relates to a jack, and particularly relates to a hydraulic jack.

BACKGROUND

Jacks are classified into mechanical jacks, hydraulic jacks, etc., and their principles are different. In terms of the principle, the most basic principle on which hydraulic transmission is based is Pascal's law. That is, the intensity of pressure borne by liquid at all positions is the same. In this way, in a balanced system, the pressure applied on a smaller piston is smaller, and the pressure applied on a larger piston is larger, so that the liquid can be kept static. Therefore, through the transmission of the liquid, there are different pressures at different ends, and a purpose of transformation can be achieved. The common hydraulic jacks achieve transmission of force by means of this principle. In screw jacks, a handle is pulled back and forth, so that a pulling claw, namely a pushing ratchet wheel, rotates in a gap, and a small bevel gear drives a large bevel gear to rotate a lifting screw, so that a lifting sleeve can be lifted or lowered to achieve the function of a lifting tension, but it is not as simple as the hydraulic jack.

The traditional hydraulic jack has a short stroke, when a lifting object (vehicle) has a high ground clearance, it cannot be used directly, and needs to be heightened by bricks and plates for use, which is very inconvenient, and poor in safety, and prone to toppling and falling, thereby causing accidents; that is to say, the conventional hydraulic jack has a narrow scope of application and cannot be applied to an off-road vehicle, especially in soft ground operation in the field.

SUMMARY

[1] Technical Problems to be Solved

According to the technical problems to be solved by the present disclosure, a hydraulic jack which is compact in structure, convenient to install, capable of adjusting height as required, and wide in range of application is provided.

[2] Technical Solution for Solving Problems

A hydraulic jack, including:

a base as a carrier for mounting other components;

an inner cylinder barrel 4 vertically fixed to the base, a sliding cavity being formed in the inner cylinder barrel 4;

an outer cylinder barrel 2 vertically and slidably fitted outside the inner cylinder barrel 4;

a valve plug assembly slidably fitted in the sliding cavity, the sliding direction of the valve plug assembly being parallel to the axis direction of the inner cylinder barrel 4, and the valve plug assembly being rigidly connected to the outer cylinder barrel 2 via a valve plug rod 5 and being able to slide synchronously with the outer cylinder barrel 2;

a valve plug driving assembly mounted on the outer cylinder barrel 2 and used for driving the valve plug assembly to slide up and down; and a supporting component mounted on the side wall of the outer cylinder barrel 2 in an up-down adjustable mode and used for supporting a lifting object.

Further, the base includes a lower base 11 and an upper base 12 which is detachably mounted on the lower base 11, a supporting base 13 is fixed to the upper base 12, and the inner cylinder barrel 4 is fixed to the supporting base 13.

Further, the supporting component includes a supporting ring 22 and a supporting block 23, the supporting ring 22 is disposed outside the outer cylinder barrel 2 in a sleeving mode and can slide up and down, the supporting block 23 is hinged to the supporting ring 22 and can rotate upwards, the axis of rotation of the supporting block 23 is perpendicular to the axis of the outer cylinder barrel 2, the inner side wall of the supporting block 23 is provided with a first limiting portion 231, and one or more second limiting portions 20 allowing the first limiting portion 231 to be clamped in so as to limit the supporting block are disposed on the side wall of the outer cylinder barrel 2 in the axis direction.

Further, the supporting block 23 is hinged to the supporting ring 22 by means of a locking bolt, and the end of the locking bolt is provided with a locking handle 24 for locking.

Further, the first limiting portion is a strip-shaped protrusion arranged horizontally, and the second limiting portion 20 is a strip-shaped groove arranged horizontally and capable of allowing the strip-shaped protrusion to be clamped in.

Further, the valve plug assembly includes a valve plug main body 3 slidably fitted in the sliding cavity, the valve plug main body 3 separates the sliding cavity into a lower cavity 40*a* and an upper cavity 40*b*, a one-way valve assembly for one-way communication between the lower cavity 40*a* and the upper cavity 40*b* is formed in the valve plug main body 3, the top of the valve plug main body 3 is rigidly connected to the outer cylinder barrel 2 via a cylinder sleeve 5, a second sliding cavity is formed in the cylinder sleeve, the second sliding cavity is in communication with the one-way valve assembly, and a sliding plug 61 is slidably fitted in the second sliding cavity; a sliding plug rod 6 is disposed on the sliding plug, the sliding plug rod 6 extends upwards to the outside of the outer cylinder barrel 2 and is connected to a rocking handle 26 hinged to the outer cylinder barrel 2, and the sliding plug is driven to move up and down by swinging the rocking handle 26 back and forth, so that hydraulic oil in the upper cavity 40*b* enters the lower cavity 40*a* via the one-way valve assembly and the outer cylinder barrel 2 is jacked up.

Further, a main flow channel communicating the upper cavity 40*b* with the lower cavity 40*a* is formed in the valve plug main body 3, two one-way valve units enabling the hydraulic oil in the upper cavity 40*b* to enter the lower cavity 40*a* in one way are disposed in the main flow channel, and an accessory flow channel communicating with the second sliding cavity is disposed between the two one-way valve units.

Further, a pressure relief hole 300*b* for communicating the upper cavity 40*b* with the lower cavity 40*a* is formed in the valve plug main body, a pressure relief rod 7 capable of blocking communication between the upper cavity and the lower cavity, and a first elastic component for enabling the pressure relief rod 7 to have a movement tendency to approach a blocking direction are disposed in the pressure relief hole 300*b* in a sleeved mode, the top of the pressure relief rod 7 extends upwards to the outside of the outer cylinder barrel 2, and the top of the outer cylinder barrel 2 is provided with a pressure relief shifting block 27 for pushing the pressure relief rod 7 to move away from the blocking direction.

Further, a buffering cavity 610 is formed in the bottom surface of the sliding plug 61, a valve hole communicating with the second sliding cavity is formed in the bottom surface of the buffering cavity 610, and a buffering steel ball 611 and a second elastic component for enabling the buffering steel ball 611 to have a downward movement tendency and blocking the valve hole are disposed in the buffering cavity 610.

The side wall of the lower end of the valve plug rod 5 is provided with one or more annular clamping grooves, a valve plug mounting hole 300*a* allowing the valve plug rod to be inserted in is formed in the top surface of the valve plug main body 3, a clamping ring is fixed to the top of the valve plug main body 3, and the inner wall of the clamping ring extends inwards in a radial direction into the annular clamping groove, so that the valve plug main body 3 is fixed.

[3] Beneficial Effects

The hydraulic jack of the present disclosure is provided with the adjustable supporting component, which can adjust the supporting height as needed, avoids the phenomenon that due to the insufficient stroke of a jack, jacking cannot be achieved, has a wide range of application, and is suitable for ground clearances of different heights. The rotating supporting block is adopted, so that quick adjustment can be realized by rotation, and operation is simple and labor-saving. A locking component is disposed to quickly lock or loosen the supporting block, so as to realize rapid adjustment, and at the same time, the safety and reliability in use are improved. The double bases are disposed, which adapts to different working conditions in use, and lifting can be carried out on a softer ground, which widens the scope of application and improves the reliability of supporting. An outer cylinder body is of a lifting type structure, so that the stroke is long, the lifting height is large, the load capacity is high, the overall structural strength is high and reliability is good. Due to the structural design of an integrated valve plug, the process difficulty and production costs are low, precision is high, and assembling is convenient and quick, which improves the reliability and stability of the jack in overall operation. A buffering structure is disposed, which improves the safety in use, avoids the situation that due to an excessive load, an oil cavity is damaged, improves the safety in use and the hand feeling of oil pressing, and makes the impact small. Due to the long arm-of-force pressure relief structure, pressure relief is convenient and labor-saving. The hydraulic jack of the present disclosure is compact in structure, high in strength, high in load capacity, long in stroke, and safe and reliable in use.

DETAILED DESCRIPTION

Figure 1:
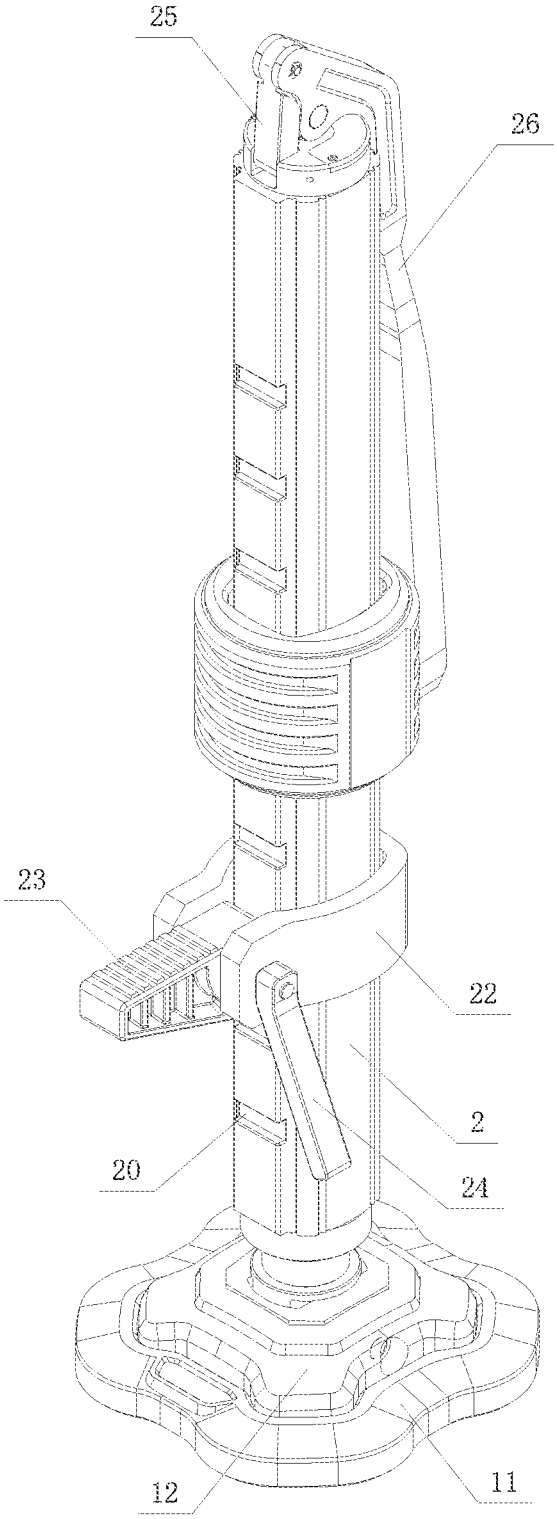
FIG. 1 is a structural schematic view of a hydraulic jack according to the present disclosure.
Figure 2:
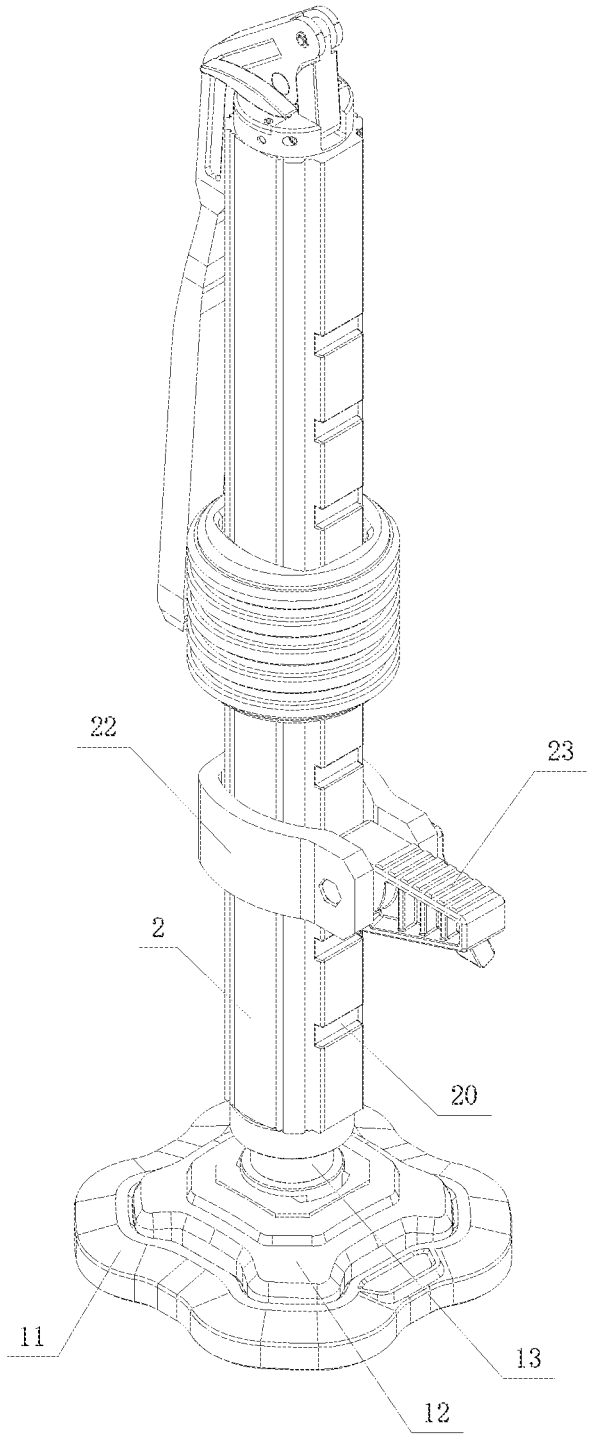
FIG. 2 is a structural schematic view of the hydraulic jack according to the present disclosure at another angle.

Embodiments of the present disclosure will be described in detail with reference to the accompanying drawings.

With reference to FIG. 1 to FIG. 9, the present disclosure provides a hydraulic jack for jacking up heavy objects, in particular for jacking vehicles, which mainly includes a base, an inner cylinder barrel 4, an outer cylinder barrel 2, a valve plug assembly, a valve plug driving assembly and a supporting component.

The inner cylinder barrel 4 is vertically fixed to the base, and a sliding cavity is formed in the inner cylinder barrel 4. The outer cylinder barrel 2 is vertically and slidably fitted outside the inner cylinder barrel 4. The valve plug assembly is slidably fitted in the sliding cavity, and the sliding direction of the valve plug assembly is parallel to the axis direction of the inner cylinder barrel 4; the valve plug assembly is rigidly connected to the outer cylinder barrel 2 via a valve plug rod 5 and is able to slide synchronously with the outer cylinder barrel 2. The valve plug driving assembly mounted on the outer cylinder barrel 2 and used for driving the valve plug assembly to slide up and down. The supporting component is mounted on the side wall of the outer cylinder barrel 2 in an up-down adjustable mode and used for supporting a lifting object, and the lifting object is usually a vehicle, a sedan with a lower chassis or an off-road vehicle with a higher chassis.

The structure of each assembly of the present disclosure is described in detail below.

With reference to FIG. 1 to FIG. 4, the base is used as a mounting carrier for mounting other components, and it has a supporting surface in contact with the ground, thus, it needs to have a certain area. In this embodiment, the base includes a lower base 11 and an upper base 12 which is detachably mounted on the lower base 11, a supporting base 13 is fixed to the upper base 12, and the inner cylinder barrel 4 is fixed to the supporting base 13. The center of the upper end of the lower base is provided with a mounting groove for mounting the upper base 12, the shape (contour) of the mounting groove is the same as the shape (contour) of the upper base, so that the upper base 12 can just be clamped in, and left-right sliding can be avoided after the upper base is clamped in, and in use, it is only needed that the upper base 12 is clamped in the mounting groove. The base can be selected according to different working conditions in use; the lower base 11 can be additionally mounted as an accessory; after the lower base 11 is additionally mounted, the contact surface between the base and the ground is larger and the height is also increased, which is suitable for use in an environment of a relatively soft ground. In order to further improve the reliability and stability of connection, supporting bosses can be disposed on four corners of the lower end face of the upper base 12, and at the same time, inserting holes corresponding to the supporting bosses are formed in the mounting groove; after the upper base 12 is placed in the mounting groove, the supporting boss is inserted into the inserting hole to achieve radial positioning, which avoids the situation that the upper base waggles left and right in the mounting groove, improves the reliability of connection with the lower base, and improves the safety in use.

With reference to FIG. 1 to FIG. 3 and FIG. 5, the supporting component is disposed outside the outer cylinder barrel 2 and is used for supporting the lifting object (an automobile, etc.), and a supporting portion moves up and down along with the outer cylinder barrel 2; specifically, the supporting component includes a supporting ring 22 and a supporting block 23, the supporting ring 22 is annular as a whole and is disposed outside the outer cylinder barrel 2 in a sleeving mode and can slide up and down, the supporting block 23 is hinged to the supporting ring 22 and can rotate upwards, the axis of rotation of the supporting block 23 is perpendicular to the axis of the outer cylinder barrel 2, a lifting surface and a bearing surface are disposed on the supporting block 23, and when the supporting block 23 is unfolded, the lifting surface is in a horizontal state, namely, the plane on which the lifting surface is located is perpendicular to the sliding direction of the outer cylinder barrel 2; anti-slip lines are formed on the lifting surface to avoid slipping, which improves the safety in use. The bearing surface is disposed on the inner side of the supporting block 23 (the side close to the outer cylinder barrel) and is located at the lower end of a hinged shaft of the supporting block 23. When the supporting block is unfolded, the bearing surface is in contact with the side wall of the outer cylinder barrel, and bears the gravity of the vehicle. In order to adapt to different working conditions in use and facilitate height adjustment, a first limiting portion 231 is disposed on the inner side wall of the supporting block 23, and the first limiting portion is located at the lower end of the hinged shaft. In this embodiment, the first limiting portion is disposed on the bearing surface; at the same time, a plurality of second limiting portions 20 allowing the first limiting portion 231 to be clamped in are disposed on the side wall of the outer cylinder barrel 2 in the axis direction, and the supporting block can be limited after the first limiting portion is clamped in the second limiting portion. In order to improve the safety and reliability in use and facilitate adjustment, in this embodiment, the supporting block 23 is hinged to the supporting ring 22 via a locking bolt, and a locking handle 24 for locking is disposed at the end of the locking bolt. When adjustment is required, the locking handle is rotated so that the supporting block 23 can rotate; after adjustment is completed, the locking handle is rotated in a reverse direction to compress the supporting block 23 so as to fix the supporting block 23, so that it cannot rotate, which improves the safety in use; both the above outer cylinder barrel and the inner cylinder barrel have a long cylindrical structure so that the stroke is long with a length of 40 cm to 120 cm in general.

With reference to FIG. 1-FIG. 3 and FIG. 6-FIG. 8, the valve plug assembly includes a valve plug main body 3, the valve plug main body 3 is slidably fitted in the sliding cavity in the inner cylinder barrel 4, the valve plug main body 3 is cylindrical as a whole, a sealing ring is disposed on the side wall of the valve plug main body 3, the valve plug main body separates the sliding cavity into a lower cavity 40*a* and an upper cavity 40*b*, the lower cavity 40*a* is located at the lower end of the valve plug main body 3, the upper cavity 40*b* is located at the upper end of the valve plug main body, both the cavities are sealed cavities, both the upper cavity 40*b* and the lower cavity 40*a* are filled with hydraulic oil, and a one-way valve assembly is formed in the valve plug main body 3. The one-way valve assembly is used for one-way communication between the lower cavity 40*a* and the upper cavity 40*b*; at the same time, the top of the valve plug main body 3 is rigidly connected to the outer cylinder barrel 2 via a cylinder sleeve 5, a second sliding cavity is formed in the cylinder sleeve, the second sliding cavity is in communication with the one-way valve assembly, and at the same time, a sliding plug 61 is slidably fitted in the second sliding cavity. A sliding plug rod 6 is disposed on the sliding plug, the sliding plug rod 6 extends upwards to the outside of the outer cylinder barrel 2 and is connected to a rocking handle 26 hinged to the outer cylinder barrel 2, and the sliding plug is driven to move up and down by the swinging the rocking handle 26 back and forth, so that the hydraulic oil in the upper cavity 40*b* enters the lower cavity 40*a* through the one-way valve assembly and the outer cylinder barrel 2 is jacked upwards; the above-mentioned valve plug rod and the rocking handle constitute the valve plug driving assembly.

Figure 6:
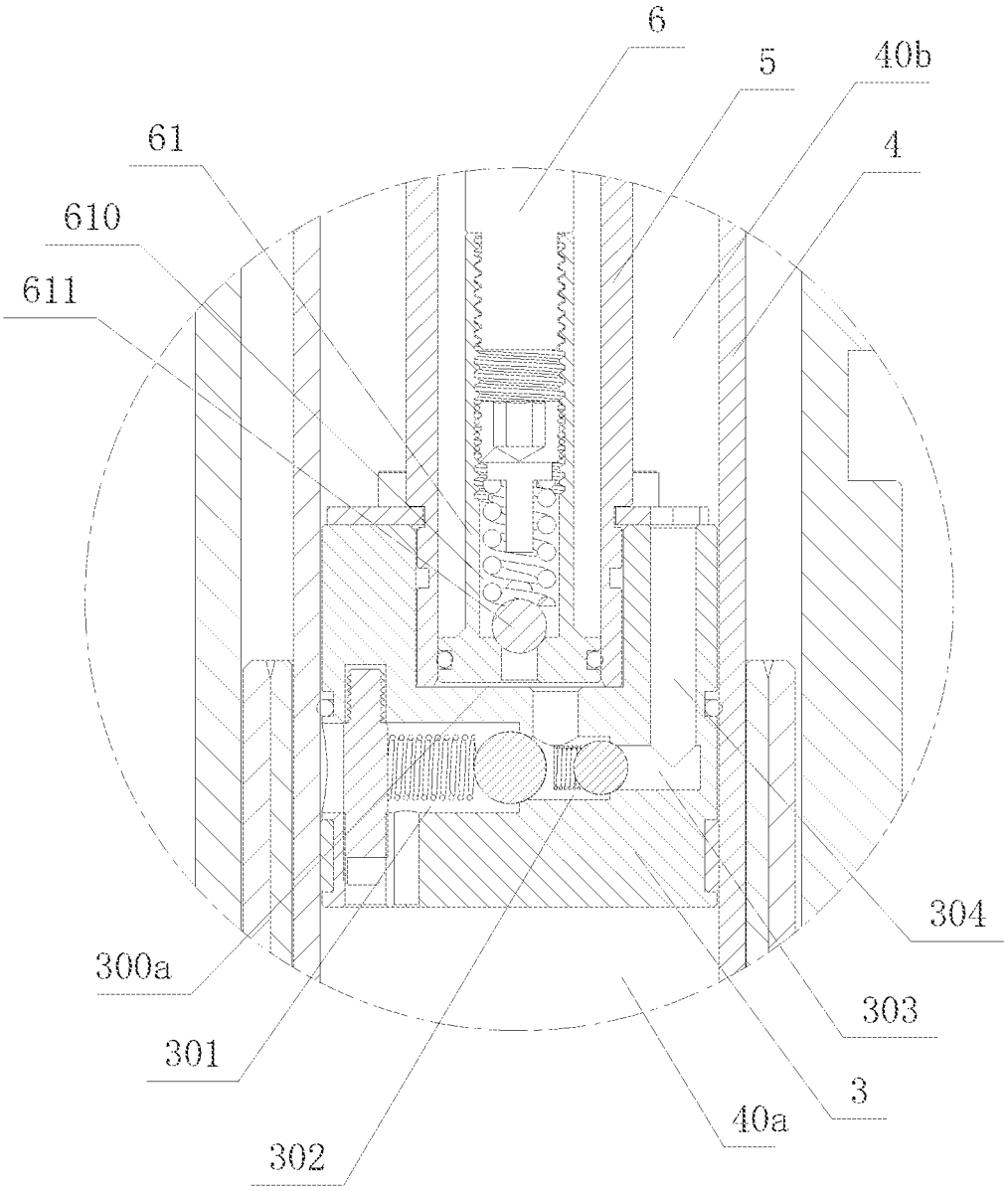
FIG. 6 is an enlarged view of a portion A in FIG. 3.

With reference to FIG. 6, in detail, a main flow channel communicating the upper cavity 40*b* with the lower cavity 40*a* is formed in the overall cylindrical valve plug main body 3, and the main flow channel includes a first hole body 301, a second hole body 302 and a third hole body 303 which are arranged horizontally and have successively reduced diameters. The end portion of the first hole body extends to the outside of the valve plug main body 3 for assembling internal parts, and at the same time, a pin hole is formed in the valve plug main body 3; a pin shaft is disposed in the pin hole, and the pin shaft is perpendicular to and intersects with the axis of the first hole body to serve as a supporting portion of a spring. A first steel ball and a third elastic component are disposed in the first hole body. One end of the third elastic component is in contact with the pin shaft, and the other end of the third elastic component is in contact with the first steel ball to enable the first steel ball to have the movement tendency to approach the second hole body so as to block the communication between the first hole body and the second hole body, the hydraulic oil can enter the first hole body from the second hole body, but cannot enter the second hole body from the first hole body, and the first hole body, the second hole body, the first steel ball and the third elastic component form a one-way valve unit. A second steel ball and a fourth elastic component are disposed in the second hole body, the fourth elastic component enables the second steel ball to have the movement tendency to approach the third hole body so as to block the communication between the second hole body and the third hole body, the hydraulic oil can enter the second hole body from the third hole body, but cannot enter the third hole body from the second hole body, and the second hole body, the third hole body, the second steel ball and the fourth elastic component form another one-way valve unit. A first oil hole is formed in the bottom surface of the valve plug main body 3, the first oil hole is in communication with the first hole body and the lower cavity 40*a*, a second oil hole 304 is formed in the top of the valve plug main body 3, and the second oil hole 304 is in communication with the third hole body and the upper cavity 40*b*.

A valve plug mounting hole 300*a* is formed in the center of the top of the valve plug main body 3, the valve plug mounting hole 300*a* just allows the lower end of the valve plug rod 5 to be inserted in, the side wall of the lower end of the valve plug rod 5 is provided with one or more annular clamping grooves, a clamping ring is fixed to the top of the valve plug main body 3 via a bolt, the clamping ring is ring-shaped as a whole, the inner wall of the clamping ring extends radially inwards into an annular clamping groove, so that the valve plug main body 3 is fixed; in this embodiment, the clamping ring is formed by splicing two semicircular clamping ring bodies, and the valve plug rod 5 is axially fixed via the clamping ring and the annular clamping groove; an accessory flow channel is formed in the bottom surface of the valve plug mounting hole, and the accessory flow channel communicates with the second hole body and the valve plug mounting hole 300*a*.

The valve plug rod 5 is a hollow rod body which is provided with a central hole and forms the second sliding cavity, the lower end of the second sliding cavity is open and is in communication with the valve plug mounting hole 300*a*, and the upper end of the valve plug rod 5 is fixedly connected to the outer cylinder barrel 2 (the top of the outer cylinder barrel is sealed), and therefore the valve plug main body moves up and down and can drive the outer cylinder barrel to move synchronously; the sliding plug 61 is slidably fitted in the second sliding cavity, and the hydraulic oil enters the lower cavity from the upper cavity by the up-down movement of the sliding plug, so that the valve plug main body 3 moves upwards, and the outer cylinder barrel is driven to move upwards.

Specifically, when the sliding plug moves upwards, the hydraulic oil in the upper cavity 40*b* flows through the second oil hole 304, and enters the second sliding cavity through the third hole body and the accessory flow channel successively after the second steel ball is ejected open; when the sliding plug moves downwards, the hydraulic oil in the second sliding cavity enters the second hole body and enters the lower cavity through the first hole body and the first oil hole after the first steel ball is ejected open, so that the hydraulic oil in the upper cavity enters the lower cavity, namely, the hydraulic oil in the upper cavity decreases, and the hydraulic oil in the lower cavity increases, which pushes the valve plug main body 3 to move upwards, and then drives the outer cylinder barrel connected to the valve plug main body 3 to move upwards synchronously; the sliding plug rod 6 is fixed to the upper end of the sliding plug 61, the sliding plug rod 6 extends upwards to the outside of the outer cylinder barrel, the rocking handle 26 is hinged to the top of the outer cylinder barrel, the axis of rotation of the rocking handle is perpendicular to the axis of the outer cylinder barrel, namely, the axis of rotation of the rocking handle is horizontally arranged, the head of the rocking handle is hinged to the sliding plug rod 6 via a connecting rod 25, and the tail of the rocking handle forms a hand-held portion for operating the rocking handle, and when the rocking handle works, the rocking handle swings back and forth to push the sliding plug to move up and down.

In order to improve the reliability and stability in use and safety in use, in this embodiment, a buffering cavity 610 is formed in the bottom surface of the sliding plug 61, a valve hole communicating with the second sliding cavity is formed in the bottom surface of the buffering cavity 610, the diameter of the valve hole is smaller than the diameter of the buffering cavity, and a buffering steel ball 611, and a second elastic component for enabling the buffering steel ball 611 to have a downward movement tendency and blocking the valve hole are disposed in the buffering cavity 610. When the pressure of the hydraulic oil in the lower cavity is too high, and then the sliding plug is pressed down, the first steel ball cannot be completely ejected open by the high-pressure oil, and then the buffering steel ball is ejected open, so that some or all of the hydraulic oil in the second sliding cavity enters the buffering cavity, which has a buffering effect, and improves the safety in use, reliability and comfortableness.

Figure 3:
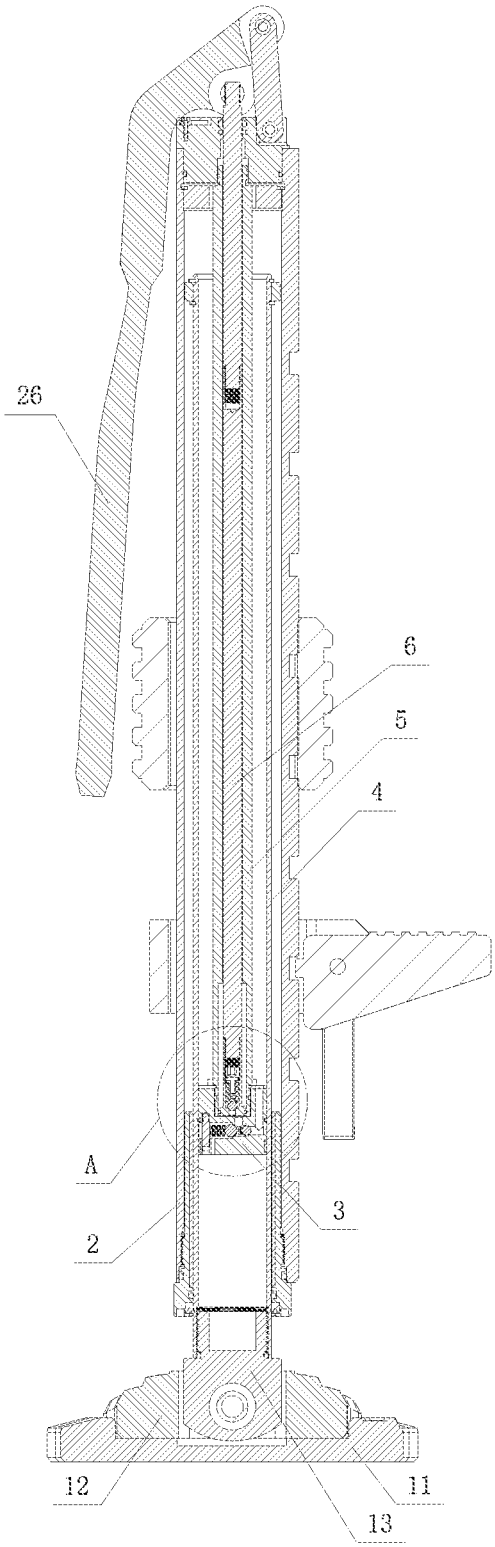
FIG. 3 is a sectional view of the hydraulic jack according to the present disclosure.
Figure 4:
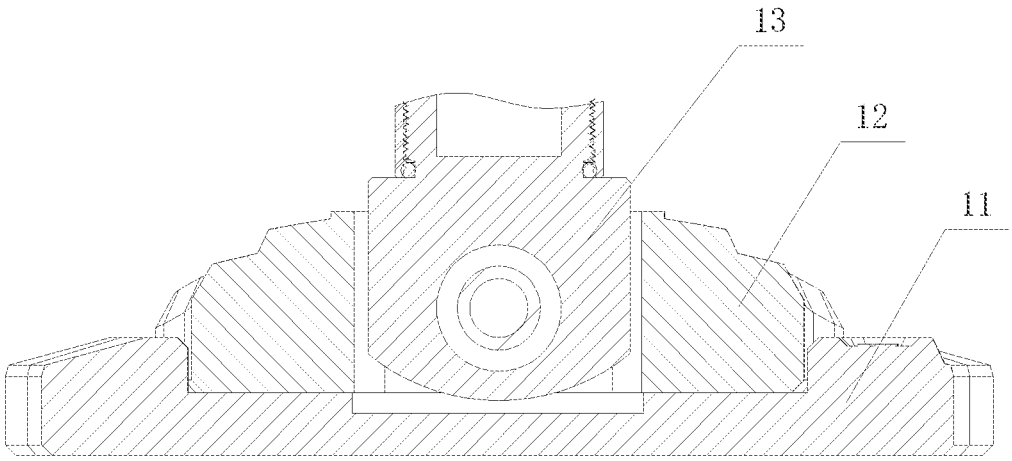
FIG. 4 is a structural schematic view of a base of the hydraulic jack according to the present disclosure.
Figure 5:
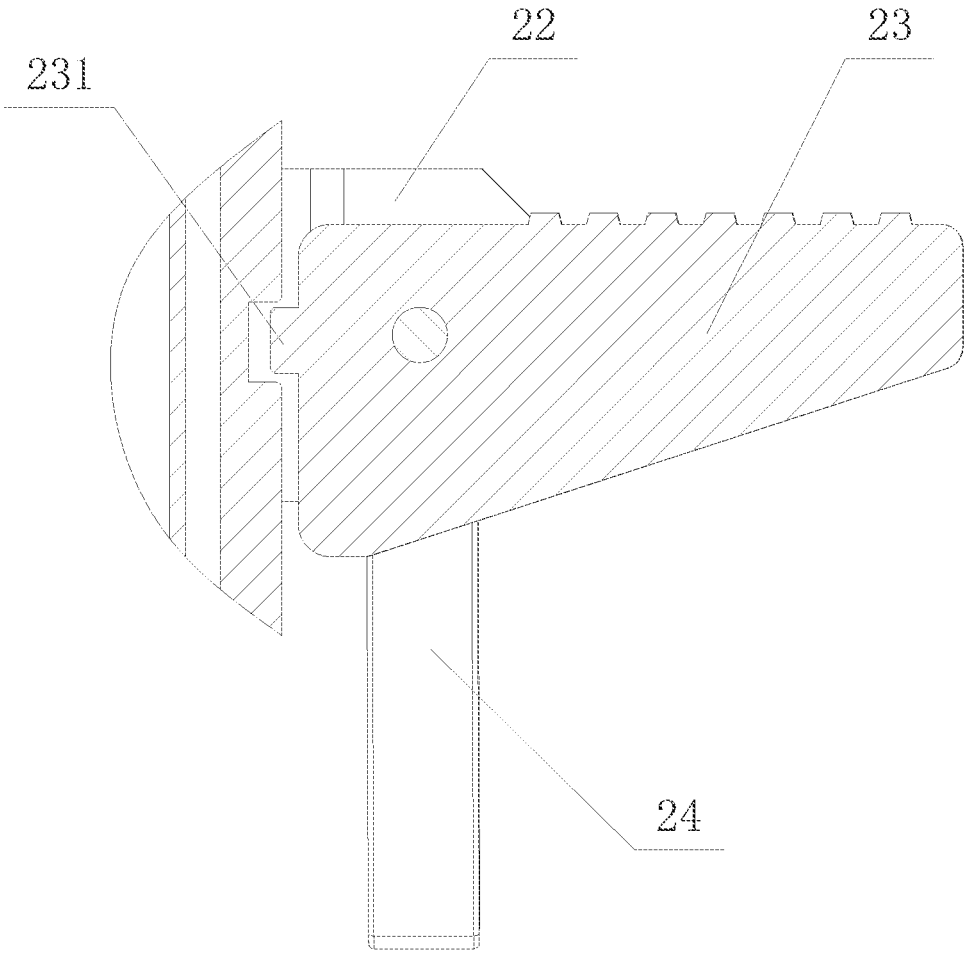
FIG. 5 is a structural schematic view of a supporting component of the hydraulic jack according to the present disclosure.
Figure 7:
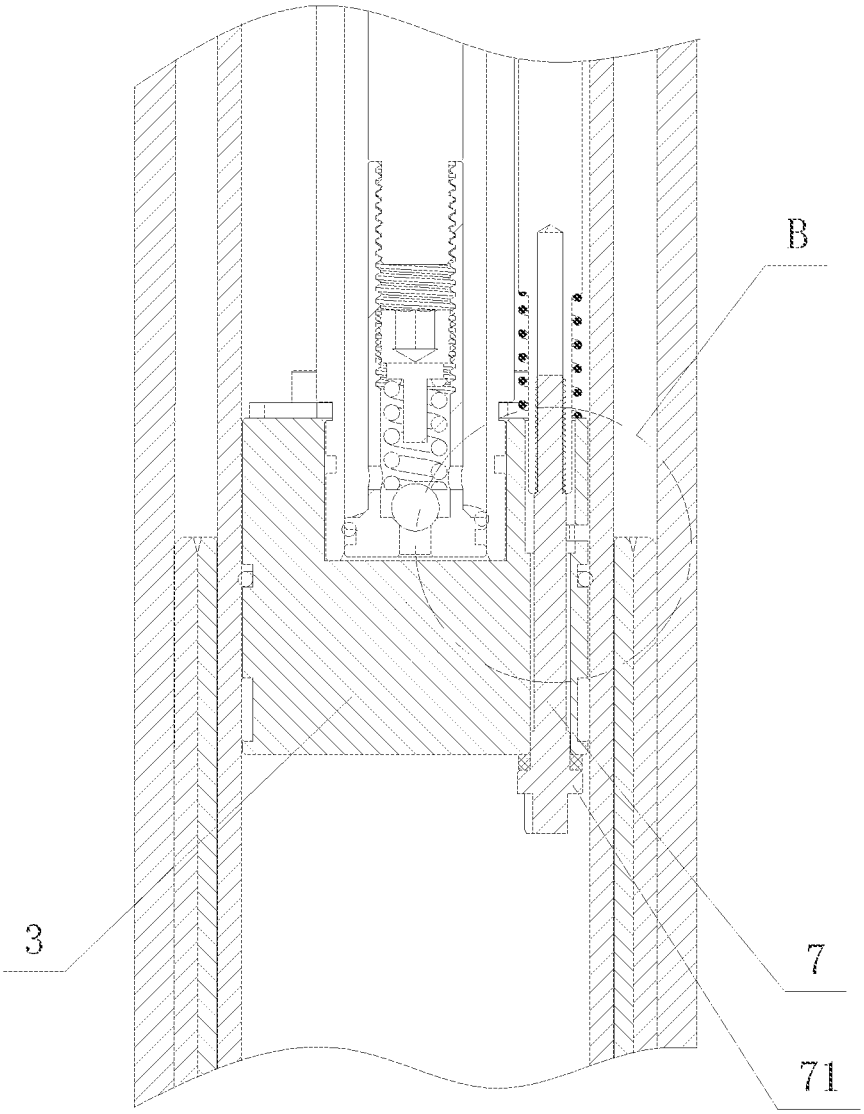
FIG. 7 is a structural schematic view of a pressure relief assembly of the hydraulic jack according to the present disclosure.
Figure 8:
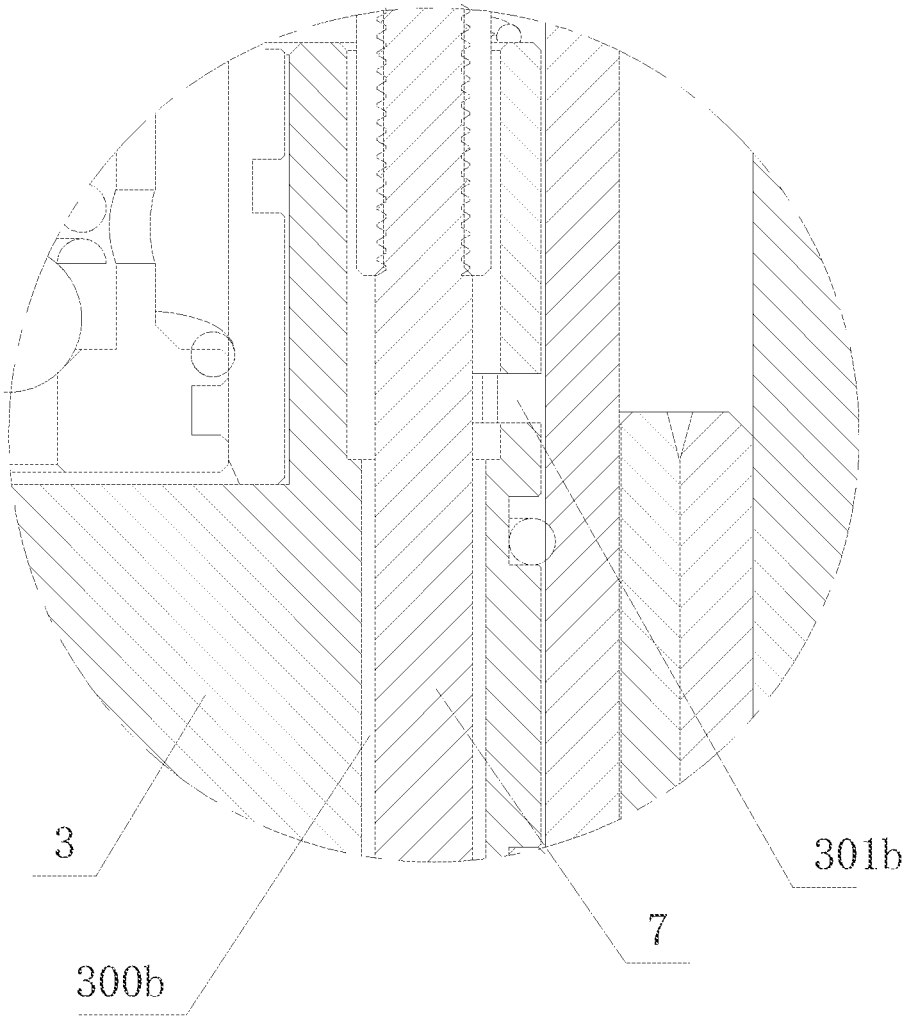
FIG. 8 is an enlarged view of a portion B in FIG. 7.
Figure 9:
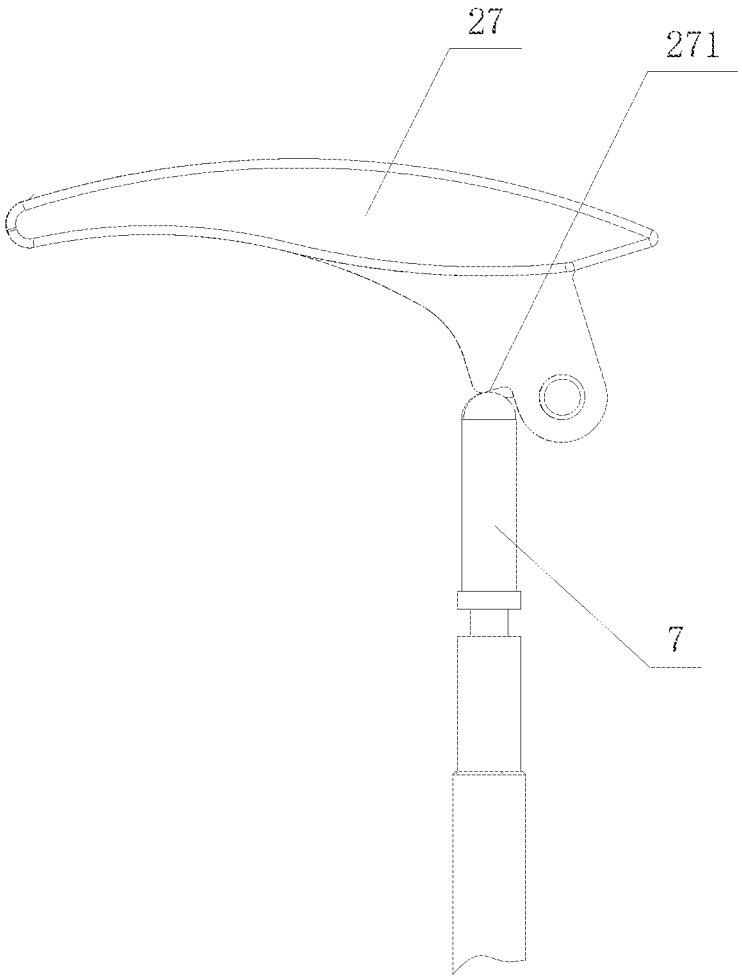
FIG. 9 is a structural schematic view of a pressure relief shifting block of the hydraulic jack according to the present disclosure.

The pressure relief mechanism is used for quickly relieving pressure so as to quickly reset the outer cylinder barrel after completing the work, and with reference to FIG. 3, FIG. 7 and FIG. 8, the pressure relief hole 300*b* communicating the upper cavity 40*b* with the lower cavity 40*a* is formed in the valve plug main body 3, the axis of the pressure relief hole 300*b* is parallel to the axis of the valve plug main body 3, the pressure relief rod 7 capable of blocking the communication between the upper cavity and the lower cavity, and the first elastic component for enabling the pressure relief rod 7 to have a movement tendency to approach the blocking direction are disposed in the pressure relief hole 300*b* in the sleeved mode, specifically, the lower end of the pressure relief rod extends downwards into the lower cavity, the end of the lower end of the pressure relief rod extends radially outward and forms a sealing portion 71, and a sealing gasket is disposed at the upper end of the sealing portion. The first elastic component enables the pressure relief rod to have an upward movement tendency, and enables the sealing portion to be attached to and compress the pressure relief hole, thereby achieving sealing; in normal work, the pressure of the lower cavity is greater than the pressure of the upper cavity, and there is also an upward thrust on the pressure relief rod. In order to facilitate the coaxiality of the pressure relief rod and at the same time, facilitate the assembly of the elastic component, the side wall of the valve plug main body 3 is provided with an oil relief hole 301*b*, the oil relief hole is in communication with the pressure relief hole 300*b* and at the same time is in communication with the upper cavity. The top of the pressure relief rod 7 extends upwards to the outside of the outer cylinder barrel 2, and at the same time, a pressure relief shifting block 27 is hinged to the top of the outer cylinder barrel. With reference to FIG. 9, the head of the pressure relief shifting block 27 is hinged to the top of the outer cylinder barrel, and the axis of rotation thereof is perpendicular to the length direction of the pressure relief rod 7; a supporting pushing surface 271 is disposed at the lower end of the pressure relief shifting block 27, and the supporting pushing surface is in contact with the top surface of the pressure relief rod to push the pressure relief shifting block to rotate downwards, and the supporting pushing surface pushes the pressure relief rod 7 to move downwards, so that the sealing portion is disengaged from the valve plug main body downwards, and then the upper cavity and the lower cavity are in communication via the pressure relief hole, which enables the hydraulic oil in the lower cavity to enter the upper cavity through the pressure relief hole so as to reset an outer cylinder body. In order to save more effort in operation, a rotating shaft of the pressure relief shifting block is close to the pressure relief rod, an arm of force is extended, and the top surface of the pressure relief rod is an arc-shaped surface or semi-spherical.

At the same time, a protective sleeve is disposed on the outer wall of the outer cylinder barrel in a sleeving mode, and the protective sleeve can move up and down for protection in use, which avoids the situation that a vehicle frame directly makes contact with and collides with the supporting ring or the outer cylinder barrel, and at the same time avoids the situation that the end of the rocking handle collides with the outer cylinder barrel.

A stroke limiting component is disposed between the outer wall of the inner cylinder barrel and the inner wall of the outer cylinder barrel to prevent the outer cylinder barrel from moving beyond the stroke, and includes a first limiting component fixed to the lower end of the inner wall of the outer cylinder barrel, and a second limiting component fixed to the upper end of the outer wall of the inner cylinder barrel; and when the outer cylinder barrel moves to an upper limit position, the first limiting component makes contact with the second limiting component.

In order to facilitate processing and assembly, a top base is sealed and fixed to the top of the outer cylinder barrel, and the rocking handle and the pressure relief shifting block are mounted on the top base.

In work, the lower base is selectively mounted at the lower end of the upper base according to the using environment and working condition, the locking handle is released, the supporting ring is adjusted to an appropriate height according to the ground clearance of the vehicle or other objects to be lifted, the supporting block is adjusted to a lower end position when the ground clearance of the vehicle or other objects to be lifted is small, and the supporting block 23 is adjusted to an upper end position when the ground clearance of the vehicle or other objects to be lifted is high. Then the supporting block 23 is unfolded, and the first limiting portion (the strip-shaped protrusion) on the inner side of the supporting block 23 is enabled to be clamped into the second limiting portion (the strip-shaped clamping groove) on the side wall of the outer cylinder barrel, and the locking handle is rotated in a reverse direction to achieve locking, so as to prevent the supporting block or the supporting ring from loosening and moving downwards; it is placed at the lower end of the lifting object (the vehicle, etc.) as a whole, so that the supporting block 23 is located below a cross beam of the vehicle, the hydraulic jack is held in one hand, the rocking handle is held in the other hand and shaken vertically back and forth to drive the sliding plug to move up and down; when the sliding plug moves upwards, the hydraulic oil in the upper cavity 40*b* flows through the second oil hole 304 and enters the second sliding cavity through the third hole body and the accessory flow channel in sequence after the second steel ball is ejected open; when the sliding plug moves downwards, the hydraulic oil in the second sliding cavity enters the second hole body and enters the lower cavity through the first hole body and the first oil hole after the first steel ball is ejected open, so that the hydraulic oil in the upper cavity enters the lower cavity, namely, the hydraulic oil in the upper cavity decreases, and the hydraulic oil in the lower cavity increases, which pushes the valve plug main body 3 to move upwards, and then drives the outer cylinder barrel connected to the valve plug main body 3 to move upwards synchronously, so that the supporting block on the side wall of the outer cylinder barrel moves upwards and jacks up the vehicle, and after jacking up to a required height, the rocking handle is stopped, so that the pressure generated by the vehicle on the outer cylinder barrel is converted into the pressure generated by the sliding plug main body on the hydraulic oil in the lower cavity, and the first steel ball functions as a one-way valve and prevents the hydraulic oil from flowing back.

When repairing, maintaining and other operations are completed, the pressure relief shifting block is pressed down (rotated), and the pressure relief shifting block pushes the pressure relief rod to move downwards against the elastic force and a certain oil pressure, so that the sealing portion at the lower end of the pressure relief rod is disengaged from the valve plug main body, and then the upper cavity and the lower cavity are in communication via the pressure relief hole, so that the hydraulic oil in the lower cavity can enter the upper cavity via the pressure relief hole, and then the outer cylinder body is reset.

The hydraulic jack of the present disclosure is provided with the adjustable supporting component, which can adjust the supporting height as needed, avoids the situation that due to the insufficient stoke of a jack, jacking up to an enough height cannot be achieved or even the supporting block cannot make contact with the bottom surface of the lifting object, has a wide range of application, and is suitable for ground clearances of different heights. The rotating supporting block is adopted, so that quick adjustment can be realized by rotation, and operation is simple and labor-saving. A locking component is disposed to quickly lock or loosen the supporting block, so as to realize rapid adjustment, and at the same time, the safety and reliability in use are improved. The double bases are disposed, which adapts to different working conditions in use, and lifting can be carried out on a softer or narrower ground, which widens the scope of application and improves the reliability of supporting. The outer cylinder body is of a lifting type structure, so that the stroke is long, the lifting height is large, the load capacity is high, the overall structural strength is high and reliability is good. Due to the structural design of an integrated valve plug, the process difficulty and production costs are low, precision is high, and assembling is convenient and quick, which improves the reliability and stability of the jack in overall operation. A buffering structure is disposed, which improves the safety in use, avoids the situation that due to an excessive load, an oil cavity is damaged, improves the safety in use and the hand feeling of oil pressing, and makes the impact small. Due to the long arm-of-force pressure relief structure, pressure relief is convenient and labor-saving. The hydraulic jack of the present disclosure is compact in structure, high in strength, high in load capacity, long in stroke, and safe and reliable in use.

The above are only the preferred embodiments of the present disclosure. It should be pointed out that for those skilled in the art, without departing from the technical principles of the present disclosure, several improvements and modifications can also be made. These improvements and modifications should also be regarded as the protection scope of the present disclosure.

What is claimed is:

1. A hydraulic jack, comprising:

a base as a carrier for mounting other components;

an inner cylinder barrel (4) vertically fixed to the base, a sliding cavity being formed in the inner cylinder barrel (4);

an outer cylinder barrel (2) vertically and slidably fitted outside the inner cylinder barrel (4);

a valve plug assembly slidably fitted in the sliding cavity, the sliding direction of the valve plug assembly being parallel to the axis direction of the inner cylinder barrel (4), and the valve plug assembly being rigidly connected to the outer cylinder barrel (2) via a valve plug rod (5) and being able to slide synchronously with the outer cylinder barrel (2);

a valve plug driving assembly mounted on the outer cylinder barrel (2) and used for driving the valve plug assembly to slide up and down; and a supporting component mounted on the side wall of the outer cylinder barrel (2) in an up-down adjustable mode and used for supporting a lifting object;

wherein the valve plug assembly comprises a valve plug main body (3) slidably fitted in the sliding cavity, the valve plug main body (3) separates the sliding cavity into a lower cavity (40*a*) and an upper cavity (40*b*), a one-way valve assembly for one-way communication between the lower cavity (40*a*) and the upper cavity (40*b*) is formed in the valve plug main body (3), the top of the valve plug main body (3) is rigidly connected to the outer cylinder barrel (2) via a cylinder sleeve (5), a second sliding cavity is formed in the cylinder sleeve, the second sliding cavity is in communication with the one-way valve assembly, and a sliding plug (61) is slidably fitted in the second sliding cavity; a sliding plug rod (6) is disposed on the sliding plug, the sliding plug rod (6) extends upwards to the outside of the outer cylinder barrel (2) and is connected to a rocking handle (26) hinged to the outer cylinder barrel (2), and the sliding plug is driven to move up and down by swinging the rocking handle (26) back and forth, so that hydraulic oil in the upper cavity (40*b*) enters the lower cavity (40*a*) via the one-way valve assembly and the outer cylinder barrel (2) is jacked up.

2. The hydraulic jack according to claim 1, wherein the base comprises a lower base (11) and an upper base (12) which is detachably mounted on the lower base (11), a supporting base (13) is fixed to the upper base (12), and the inner cylinder barrel (4) is fixed to the supporting base (13).

3. The hydraulic jack according to claim 1, wherein the supporting component comprises a supporting ring (22) and a supporting block (23), the supporting ring (22) is disposed outside the outer cylinder barrel (2) in a sleeving mode and can slide up and down, the supporting block (23) is hinged to the supporting ring (22) and can rotate upwards, the axis of rotation of the supporting block (23) is perpendicular to the axis of the outer cylinder barrel (2), the inner side wall of the supporting block (23) is provided with a first limiting portion (231), and one or more second limiting portions (20) allowing the first limiting portion (231) to be clamped in so as to limit the supporting block are disposed on the side wall of the outer cylinder barrel (2) in the axis direction.

4. The hydraulic jack according to claim 3, wherein the supporting block (23) is hinged to the supporting ring (22) by means of a locking bolt, and the end of the locking bolt is provided with a locking handle (24) for locking.

5. The hydraulic jack according to claim 3, wherein the first limiting portion is a strip-shaped protrusion arranged horizontally, and the second limiting portion (20) is a strip-shaped groove arranged horizontally and capable of allowing the strip-shaped protrusion to be clamped in.

6. The hydraulic jack according to claim 1, wherein a main flow channel communicating the upper cavity (40*b*) with the lower cavity (40*a*) is formed in the valve plug main body (3), two one-way valve units enabling the hydraulic oil in the upper cavity (40*b*) to enter the lower cavity (40*a*) in one way are disposed in the main flow channel, and an accessory flow channel communicating with the second sliding cavity is disposed between the two one-way valve units.

7. The hydraulic jack according to claim 1, wherein a pressure relief hole (300*b*) for communicating the upper cavity (40*b*) with the lower cavity (40*a*) is formed in the valve plug main body, a pressure relief rod (7) capable of blocking communication between the upper cavity and the lower cavity, and a first elastic component for enabling the pressure relief rod (7) to have a movement tendency to approach a blocking direction are disposed in the pressure relief hole (300*b*) in a sleeved mode, the top of the pressure relief rod (7) extends upwards to the outside of the outer cylinder barrel (2), and the top of the outer cylinder barrel (2) is provided with a pressure relief shifting block (27) for pushing the pressure relief rod (7) to move away from the blocking direction.

8. The hydraulic jack according to claim 1, wherein a buffering cavity (610) is formed in the bottom surface of the sliding plug (61), a valve hole communicating with the second sliding cavity is formed in the bottom surface of the buffering cavity (610), and a buffering steel ball (611) and a second elastic component for enabling the buffering steel ball (611) to have a downward movement tendency and blocking the valve hole are disposed in the buffering cavity (610).

9. The hydraulic jack according to claim 1, wherein a side wall of the lower end of the valve plug rod (5) is provided with one or more annular clamping grooves, a valve plug mounting hole (300*a*) allowing the valve plug rod to be inserted in is formed in the top surface of the valve plug main body (3), a clamping ring is fixed to the top of the valve plug main body (3), and the inner wall of the clamping ring extends inwards in a radial direction into the annular clamping groove, so that the valve plug main body (3) is fixed.

* * * * *